US009020368B2

(12) United States Patent
Uohashi

(10) Patent No.: US 9,020,368 B2
(45) Date of Patent: Apr. 28, 2015

(54) SWITCH MECHANISM, ELECTRONIC DEVICE AND IMAGE FORMING APPARATUS

(71) Applicant: Kyocera Document Solutions Inc., Osaka (JP)

(72) Inventor: Yuki Uohashi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/970,784

(22) Filed: Aug. 20, 2013

(65) Prior Publication Data

US 2014/0056598 A1 Feb. 27, 2014

(30) Foreign Application Priority Data

Aug. 24, 2012 (JP) ..... 2012-184866

(51) Int. Cl.
*G03G 21/16* (2006.01)
*H01H 13/02* (2006.01)

(52) U.S. Cl.
CPC ..... *H01H 13/02* (2013.01); *G03G 21/1652* (2013.01)

(58) Field of Classification Search
CPC ..... G03G 21/1652
USPC ..... 200/520, 341; 399/107, 124, 125, 360
See application file for complete search history.

(56) References Cited

U.S. PATENT DOCUMENTS 8,044,313 B2 * 10/2011 Yamamoto ..... 200/341 X
2010/0078884 A1 * 4/2010 Uehara ..... 399/107 X

FOREIGN PATENT DOCUMENTS

| | | | |
|---|---|---|---|
| JP | S62-67426 | U | 4/1987 |
| JP | S63-167624 | U | 11/1988 |
| JP | H1-258329 | A | 10/1989 |
| JP | 2000-311544 | A | 11/2000 |
| JP | 2002-124777 | A | 4/2002 |
| JP | 2002-190228 | | 7/2002 |
| JP | 2011-248172 | A | 12/2011 |
| JP | 2012-033390 | | 2/2012 |

* cited by examiner

*Primary Examiner* — Sandra Brase
(74) *Attorney, Agent, or Firm* — Morgan, Lewis & Bockius LLP

(57) ABSTRACT

A switch mechanism of the present disclosure includes a first member, a second member, a switch, a pressing-down member and an operation member. The second member can be moved with respect to the first member. The switch is provided in the first member. The pressing-down member is provided in the first member so as to press down the switch, and in the pressing-down member, a regulation portion that restricts the amount of pressing of the switch is formed. The operation member is provided in the second member such that the operation member can be operated by a user and is pressed down by the user so as to press the pressing-down member.

12 Claims, 6 Drawing Sheets

SWITCH MECHANISM, ELECTRONIC DEVICE AND IMAGE FORMING APPARATUS

This application is based upon and claims the benefit of priority from the corresponding Japanese Patent Application No. 2012-184866 filed on Aug. 24, 2012, the entire contents of which are incorporated herein by reference.

BACKGROUND

The present disclosure relates to a switch mechanism, an electronic device and an image forming apparatus, and more particularly relates to a switch mechanism including a switch and an operation member that is operated by a user so as to press down the switch, an electronic device and an image forming apparatus.

In an electronic device, in general, a switch, which is an electronic component, and an operation member that is operated by a user so as to press down the switch are provided. For example, in an image forming apparatus, which is an example of an electronic device, since it is necessary to provide, in the front surface portion and the side surface portion of an apparatus main body, an operation panel, a manual feed tray, a cover member that can be opened and closed and the like, it is difficult to enhance the flexibility of the arrangement of a switch and an operation member. The same is true for electronic devices other than the image forming apparatus.

Hence, image forming apparatuses (electronic devices) that can improve the inconvenience described above are proposed.

As the image forming apparatus as described above, there is known an image forming apparatus (electronic device) that includes: an apparatus main body; an outer cover which can be opened and closed with respect to the apparatus main body; a power supply switch (switch) which is provided in the apparatus main body; and a button member (operation member) which is provided in the outer cover so that the user can operate it and which can press down the power supply switch. In this image forming apparatus, since the button member operated by the user can be provided in the outer cover, it is possible to enhance the flexibility of the arrangement of the power supply switch and the button member.

In this image forming apparatus, the power supply switch is provided in the apparatus main body whereas the button member is provided in a member (outer cover) that can be moved with respect to the apparatus main body, and thus the accuracy of assembly of the power supply switch and the button member is reduced. Hence, in order to reliably press down the power supply switch, it is necessary to acquire, to some degree, the amount of pressing of the button member. In this image forming apparatus, a relatively large power supply switch is used so that it is possible to absorb the amount of pressing of the button member.

However, in a small-sized switch such as a tactile switch, the amount of stroke for the turning on and off of the switch is small (for example, about 0.5 mm). Hence, in a case where the small-sized switch such as a tactile switch is used, when the amount of pressing of the operation member is increased so that the operation member is reliably brought into contact with the operation member, the switch cannot absorb the amount of pressing of the operation member. Disadvantageously, this may cause the switch to be damaged.

The present disclosure is made to solve the foregoing problem; an object of the present disclosure is to provide a switch mechanism that can enhance the flexibility of the arrangement of a switch and an operation member and that can enhance the stability of the operation of the switch, an electronic device and an image forming apparatus.

SUMMARY

A switch mechanism according to one aspect of the present disclosure includes a first member, a second member, a switch, a pressing-down member and an operation member. The second member can be moved with respect to the first member. The switch is provided in the first member. The pressing-down member is provided in the first member so as to press down the switch, and in the pressing-down member, a regulation portion that restricts the amount of pressing of the switch is formed. The operation member is provided in the second member such that the operation member can be operated by a user, and is pressed down by the user so as to press the pressing-down member.

Other objects of the present disclosure and specific advantages obtained by the present disclosure will become further apparent from the description of an embodiment given below.

DETAILED DESCRIPTION

An embodiment of the present disclosure will be described below with reference to accompanying drawings.

Figure 1:
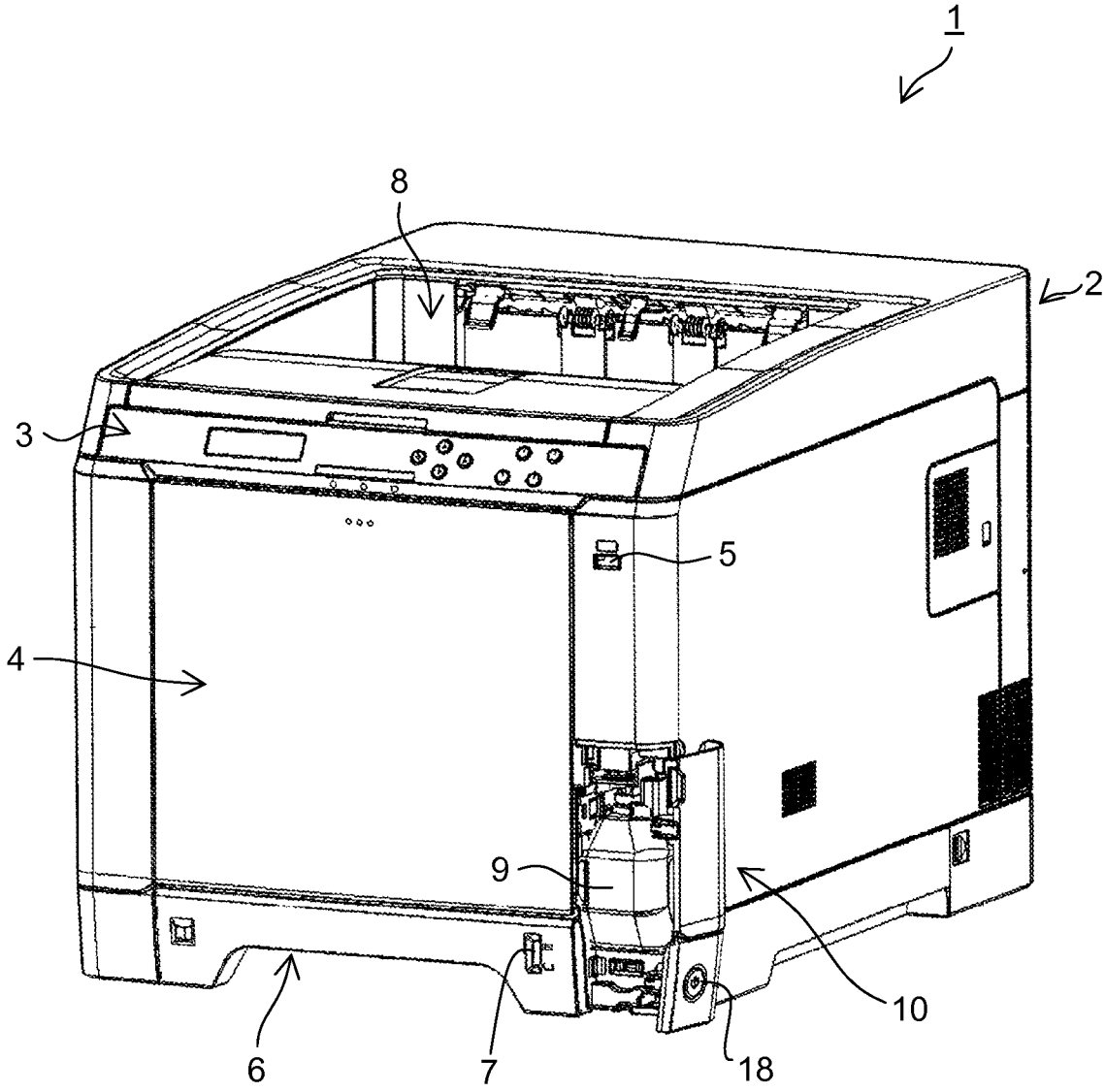
FIG. 1 is a perspective view showing the structure of an image forming apparatus according to an embodiment of the present disclosure.

An image forming apparatus (electronic device) 1 according to the embodiment of the present disclosure will be described with reference to FIGS. 1 to 7. As shown in FIG. 1, the image forming apparatus 1 includes an apparatus main body (first member) 2 having an approximate hexahedron structure. In the front surface portion of the apparatus main body 2, which the user of the apparatus main body 2 faces, an operation panel 3, a front cover 4 that is attached so as to be able to be opened and closed with respect to the apparatus main body 2 and that is opened to serve as a manual tray, a USB port 5 that is arranged in an upper right part and a sheet cassette 6 that can be removed and inserted with respect to the apparatus main body 2 are provided. In the sheet cassette 6, an indicator 7 is provided that shows the remaining number of sheets. In an upper portion of the apparatus main body 2, an ejection tray 8 into which the sheet is ejected is provided.

Within the apparatus main body 2, an image formation portion, a fixing portion, a sheet transport passage and the like, which are not shown, are provided. The image formation portion transfers, based on image data acquired from a higher-level device such as a personal computer, a toner image to the sheet supplied to form an image. The image formation portion includes: a photoconductive member drum that carries an electrostatic latent image; a charging unit that charges the surface of the photoconductive member drum; an exposure unit that forms the electrostatic latent image corresponding to an original document image on the surface of the photoconductive member drum with a laser beam or the like; a development unit that adheres a developer to the formed electrostatic latent image to form the toner image; a transfer roller that transfers the toner image to the sheet; and a cleaning blade that removes the toner left on the surface of the photoconductive member drum. The fixing portion heats and pressurizes the sheet to which the toner image has been transferred, and thereby fixes the toner image on the sheet.

Figure 2:
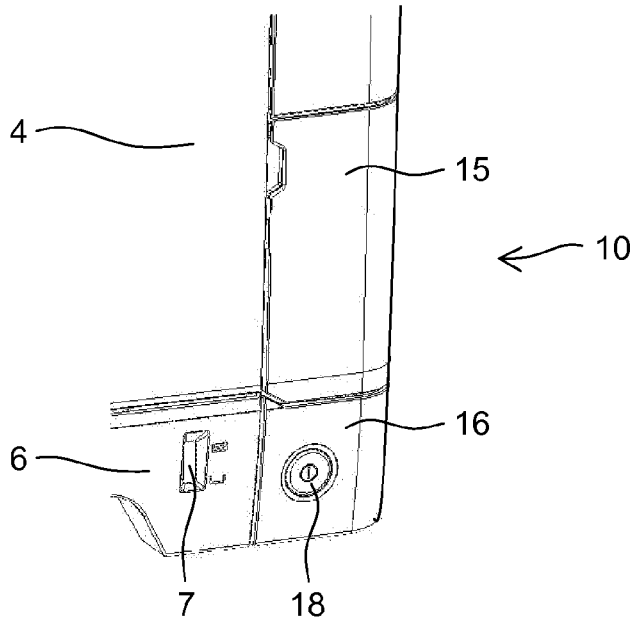
FIG. 2 is a perspective view showing the closed state of a cover member in the embodiment of the present disclosure.
Figure 4:
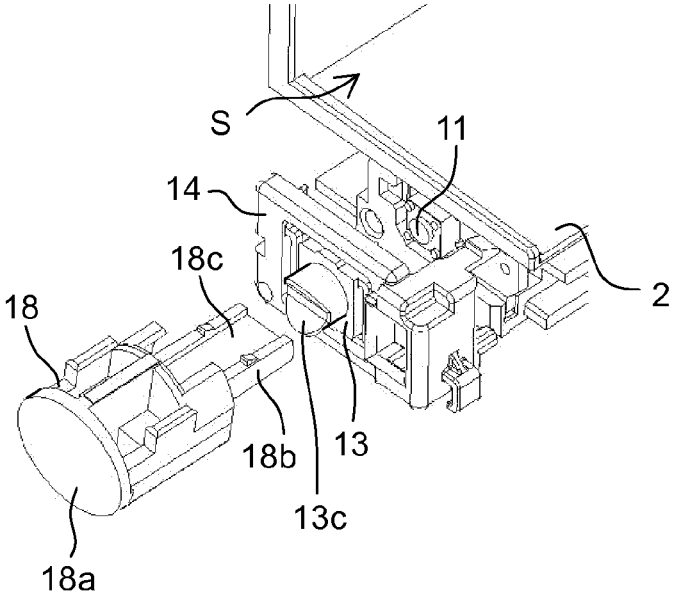
FIG. 4 is a perspective view showing the structure of an operation member, a pressing-down member, a power supply switch and the vicinity thereof in the embodiment of the present disclosure.

In a lower right part of the front portion of the apparatus main body 2, as shown in FIGS. 1 and 2, a cover member (second member) 10 is attached that can be opened and closed with respect to the apparatus main body 2 with one end used as a rotation pivot. The cover member 10 is provided so as to cover the front surface side of a waste toner bottle (waste toner container) 9 that collects the toner which has not been used for the development. The waste toner bottle 9 is held in a holding space S of the apparatus main body 2. Below the holding space S, as shown in FIG. 4, a power supply switch (switch) 11, which is an electronic component, is provided. The power supply switch 11 is a switch for switching on and off power supply to the apparatus main body 2, and is fixed to the apparatus main body 2 through a switch attachment board 12 (see FIG. 5).

The power supply switch 11 is a tactile switch such as a tact switch (Japanese registered trademark). The amount of stroke for the turning on and off of the power supply switch 11 is small, for example, about 0.5 mm.

Figure 5:
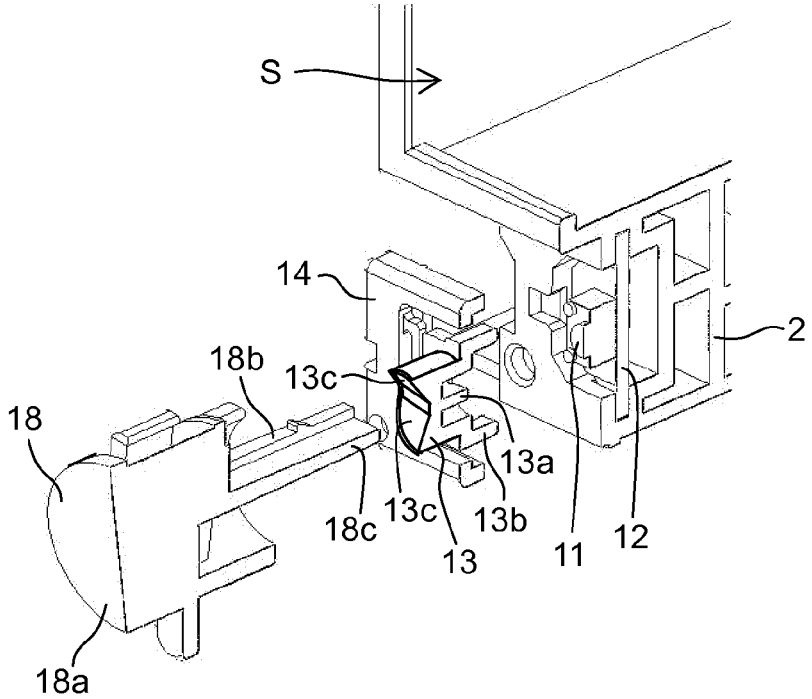
FIG. 5 is a cross-sectional perspective view showing the structure of the operation member, the pressing-down member, the power supply switch and the vicinity thereof in the embodiment of the present disclosure.

On the front surface side (the opposite side to the switch attachment board 12) of the power supply switch 11, a pressing-down member 13 for pressing down the power supply switch 11 is provided. The pressing-down member 13 is attached to the apparatus main body 2. The pressing-down member 13 includes, as shown in FIG. 5, a protrusion portion 13*a* that presses down the power supply switch 11 and a regulation portion 13*b* that restricts the amount of pressing down of the power supply switch 11. The regulation portion 13*b* is configured such that, when the protrusion portion 13*a* presses down the power supply switch 11*a* predetermined amount (for example, about 0.5 mm), the regulation portion 13*b* is pressed onto the switch attachment board 12. In other words, the pressing-down member 13 is restricted by the regulation portion 13*b* such that the amount of pressing down of the power supply switch 11 is not excessively large.

Figure 6:
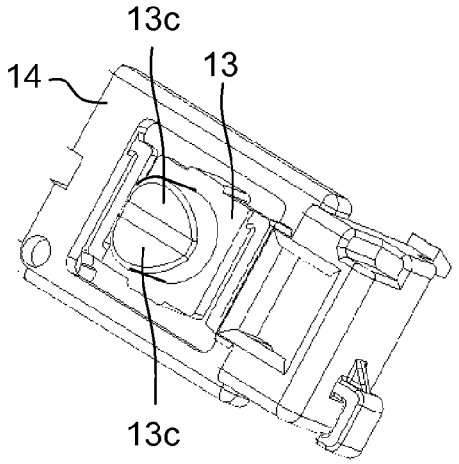
FIG. 6 is a perspective view showing the structure of the pressing-down member and an anti-drop member in the embodiment of the present disclosure.

Around the pressing-down member 13, as shown in FIGS. 4 and 6, an anti-drop member 14 for preventing the pressing-down member 13 from coming off to the opposite side to the switch attachment board 12 is provided. The anti-drop member 14 is fixed to the apparatus main body 2.

Figure 3:
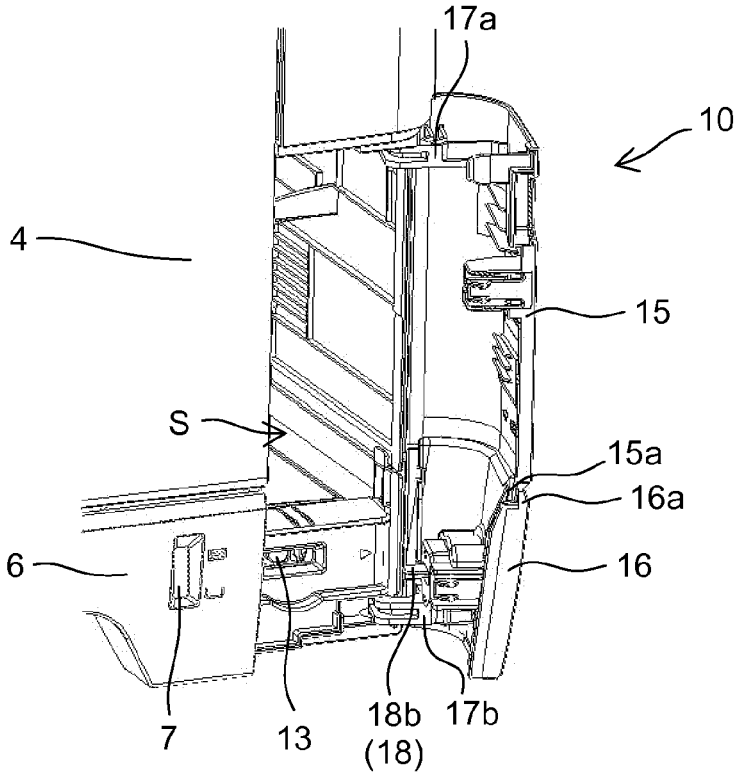
FIG. 3 is a perspective view showing the opened state of the cover member in the embodiment of the present disclosure.

The cover member 10 includes, as shown in FIG. 3, an upper side cover member 15 that is located in the side of the front cover 4 and a lower side cover member 16 that is located in the side of the sheet cassette 6. At the lower end of the upper side cover member 15 and at the upper end of the lower side cover member 16, engagement portions 15*a* and 16*a* engaging with each other are provided. The upper side cover member 15 and the lower side cover member 16 engage with each other, and are together opened and closed with respect to the apparatus main body 2. At the upper portion of the upper side cover member 15 and at the lower portion of the lower side cover member 16, hinges 17*a* and 17*b* supporting the cover member 10 such that the cover member 10 can be opened and closed are respectively provided. The upper side cover member 15 and the lower side cover member 16 engage, through the hinges 17*a* and 17*b*, with the cover member forming the right side surface of the apparatus main body 2.

In the apparatus main body 2, an opening and closing detection switch (opening and closing detection mechanism) (not shown) that detects the opened or closed state of the cover member 10 is provided. The opening and closing detection switch is pressed down by the protrusion portion of the cover member 10 when the cover member 10 is closed. Thus, the opened or closed state of the cover member 10 is detected. A control portion (not shown) is connected to the opening and closing detection switch. When the control portion determines, based on the result of the detection of the opening and closing detection switch, that the cover member 10 is in the opened state, the control portion temporarily stops image formation processing on the apparatus main body 2. Here, the control portion displays, on a display portion provided on the operation panel 3, a warning indicating that the cover member 10 is in the opened state and a message that prompts the user to close the cover member 10. On the other hand, when the control portion determines that the cover member 10 is in the closed state, the control portion allows the apparatus main body 2 to perform the image formation processing. The control portion, the display portion of the operation panel 3 and like constitute a notification mechanism.

In the cover member 10, an operation member 18 that the user presses down (operates) in order to turn on and off power supply to the apparatus main body 2 is also provided. The operation member 18, the pressing-down member 13, the power supply switch 11, part of the apparatus main body 2 and the cover member 10 constitute a switch mechanism. Although in the present embodiment, the first member forms the part of the apparatus main body 2, the first member may be a member that is attached to the apparatus main body 2.

The operation member 18 includes, as shown in FIG. 4, a button main body portion 18*a* that is pressed down by the user and a protrusion portion 18*b* that protrudes from the button main body portion 18*a* toward the interior of the apparatus main body 2. The protrusion portion 18*b* is provided such that the protrusion portion 18*b* can press the pressing-down member 13.

Figure 7:
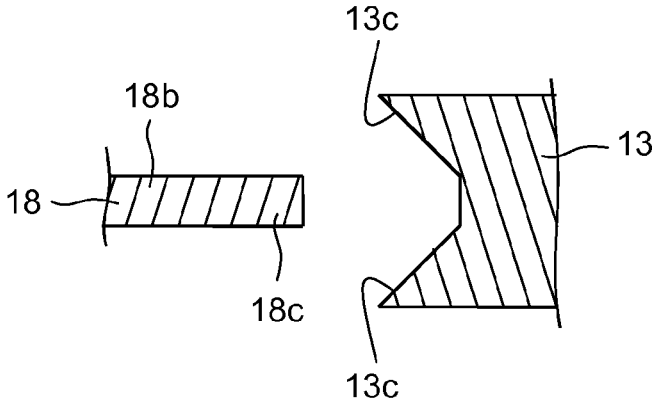
FIG. 7 is an enlarged cross-sectional view showing the structure of the operation member and the pressing-down member in the embodiment of the present disclosure.

Here, in the present embodiment, a contact (pressed) portion between the operation member 18 and the pressing-down member 13 is formed so as to guide the center portion of the operation member 18 to the center portion of the pressing-down member 13. Specifically, as shown in FIGS. 4 and 7, in the front end portion (the end portion on the side of the pressing-down member 13) of the protrusion portion 18*b* of the operation member 18, a plate-shaped portion 18*c* having a rectangular cross section and extending in a predetermined direction (left/right direction in the figure) is formed. On the other hand, in the end portion of the pressing-down member 13 on the side of the operation member 18, a pair of inclination surfaces (guide portion) 13*c* are formed that are inclined from the outer edge portion of the end portion toward the center portion as they extend away from the operation member 18.

Around the protrusion portion 18*b*, a spring member (not shown) formed with a compression coil is provided, and a force acting toward the front surface side (the opposite side to the pressing-down member 13) is applied to the operation member 18. Thus, when the pressing down of the operation member 18 by the user is cancelled, the operation member 18 is substantially flush with the surface of the lower side cover member 16 through the force applied by the spring member.

The operation of the operation member 18, the pressing-down member 13 and the power supply switch 11 will now be described.

When the cover member 10 is in the closed state, and the power supply to the apparatus main body 2 is in the off state, the operation member 18 is substantially flush with the surface of the lower side cover member 16.

When the user presses down the operation member 18, the operation member 18 enters the interior through the surface of the lower side cover member 16, and the protrusion portion 18*b* of the operation member 18 presses the pressing-down member 13. Here, since, in the pressing-down member 13, the pair of inclination surfaces 13*c* are formed that are inclined from the outer edge portion of the end portion toward the center portion as they extend away from the operation member 18, the center portion of the operation member 18 is guided to the center portion of the pressing-down member 13, and thus the operation member 18 reliably presses the pressing-down member 13. Then, the pressing-down member 13 presses down the power supply switch 11 to turn on the power supply switch 11. In this way, the power supply to the apparatus main body 2 is turned on, and thus the apparatus main body 2 can perform the image formation processing.

Thereafter, when the user presses down the operation member 18 again with the operation member 18 substantially flush with the surface of the lower side cover member 16, the pressing-down member 13 presses down the power supply switch 11 to turn off the power supply switch 11. Thus, the power supply to the apparatus main body 2 is turned off.

In the present embodiment, as described above, the pressing-down member 13 that presses down the power supply switch 11 and the operation member 18 that is provided in the cover member 10 so as to be able to be operated by the user and that is pressed down by the user to press the pressing-down member 13 are provided. Thus, the operation member 18 that is operated by the user so as to press down the power supply switch 11 can be provided in the cover member 10 that can be moved with respect to the apparatus main body 2 provided with the power supply switch 11. Hence, it is possible to enhance the flexibility of the arrangement of the power supply switch 11 and the operation member 18. Then, it is possible to enhance the flexibility of the design of the switch mechanism.

In the pressing-down member 13, the regulation portion 13*b* that restricts the amount of pressing down of the power supply switch 11 is formed. Thus, even when a small-sized power supply switch 11 is used, it is possible to prevent the amount of pressing down of the pressing-down member 13 on the power supply switch 11 from being excessively increased to damage the power supply switch 11. Hence, when the provision of the operation member 18 in the member (cover member 10) that can be moved with respect to the apparatus main body 2 reduces the accuracy of assembly of the operation member 18 and the pressing-down member 13, the amount of pressing of the operation member 18 is increased and thus it is possible to reliably bring the operation member 18 into contact with the pressing-down member 13. In this way, it is possible to enhance the stability of the operation of the power supply switch 11. In a configuration in which the power supply switch is directly pressed down by the operation member without any provision of the pressing-down member, in order to prevent the power supply switch from being damaged by the operation member, it is necessary to reduce the amount of pressing of the operation member, and thus the operation of the switch is probably unstable.

As described above, in the end portion of the pressing-down member 13 on the side of the operation member 18, the pair of inclination surfaces (guide portion) 13*c* are formed that guide the center portion of the operation member 18 to the center portion of the pressing-down member 13. In this way, even when the accuracy of assembly of the operation member 18 and the pressing-down member 13 is lowered, it is possible to guide the center portion of the operation member 18 to the center portion of the pressing-down member 13 and thereby more reliably bring the operation member 18 into contact with the pressing-down member 13.

As described above, since the pair of inclination surfaces 13*c* are inclined from the outer edge portion of the end portion of the pressing-down member 13 toward the center portion as they extend away from the operation member 18. Thus, it is possible to easily guide the center portion of the operation member 18 to the center portion of the pressing-down member 13.

When the tactile switch that is easily damaged due to a small amount of stroke is used as described above, it is particularly effective to apply the present disclosure.

It should be considered that the embodiment disclosed herein is illustrative in all respects, and not restrictive. The scope of the present disclosure is indicated not by the description of the above embodiment but by the scope of claims; furthermore, meanings equivalent to the scope of claims and all modifications with the scope are included.

For example, although in the above embodiment, the example where the present disclosure is applied to the image forming apparatus has been described, the present disclosure is not limited to this configuration. Needless to say, the present disclosure can be applied to various electronic devices that include the switch provided in the first member and the operation member provided in the second member which can be moved with respect to the first member.

Although in the above embodiment, the example where the first member forms the apparatus main body and the second member can be moved with respect to the apparatus main body has been described, as long as the second member can be moved with respect to the first member, both the first member and the second member may be moved with respect to the apparatus main body.

Although in the above embodiment, the example where the second member can be moved to open with respect to the first member like a pivoted door has been described, the second member may be moved to slide with respect to the first member.

Although in the above embodiment, the example where the plate-shaped portion extending in the predetermined direction is provided in the front end portion of the operation member, and the pair of inclination surfaces are provided in the pressing-down member has been described, the present disclosure is not limited to this configuration. The front end portion of the operation member may be formed in the shape of a bar, and an inclination surface formed in the shape of a mortar may be provided in the pressing-down member. With this configuration, it is possible to more exactly guide the center portion of the operation member to the center portion of the pressing-down member.

Figure 8:
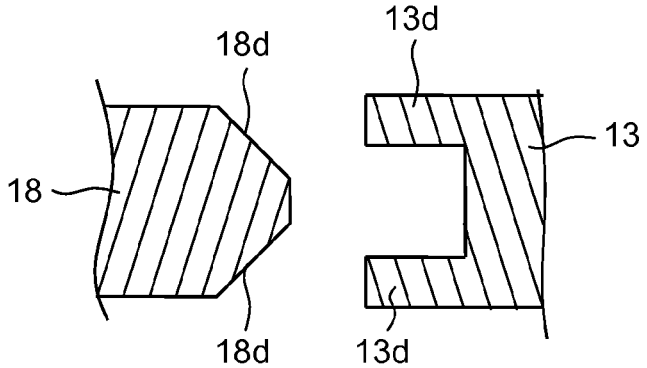
FIG. 8 is an enlarged cross-sectional view showing the structure of an operation member and a pressing-down member in a first variation of the present disclosure.

Although in the above embodiment, the example where the inclination surfaces are provided in the pressing-down member to guide the center portion of the operation member to the center portion of the pressing-down member has been described, the present disclosure is not limited to this configuration. For example, as in a first variation of the present disclosure shown in FIG. 8, in the front end portion of the operation member 18, inclination surfaces (guide portion) 18*d* that are inclined from the outer edge portion of the end portion toward the center portion as they are brought closer to the pressing-down member 13 may be provided, and a convex portion (guide portion) 13*d* that sandwiches the inclination surfaces 18*d* of the operation member 18 may be provided in the pressing-down member 13. In this case, it is also possible to guide the center portion of the operation member 18 to the center portion of the pressing-down member 13. Inclination surfaces (guide portion) may be provides both in the operation member 18 and in the pressing-down member 13.

Figure 9:
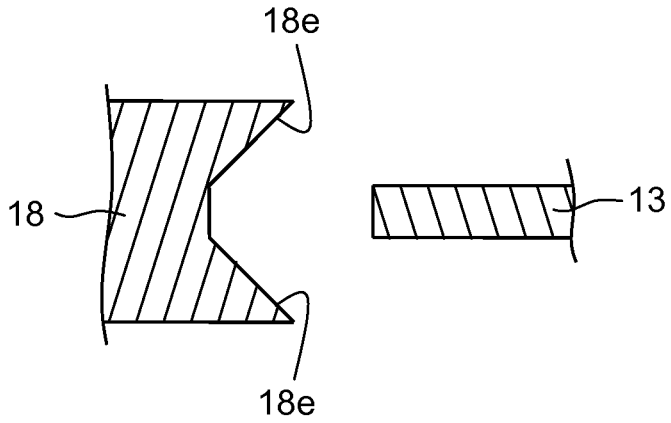
FIG. 9 is an enlarged cross-sectional view showing the structure of an operation member and a pressing-down member in a second variation of the present disclosure.
Figure 10:
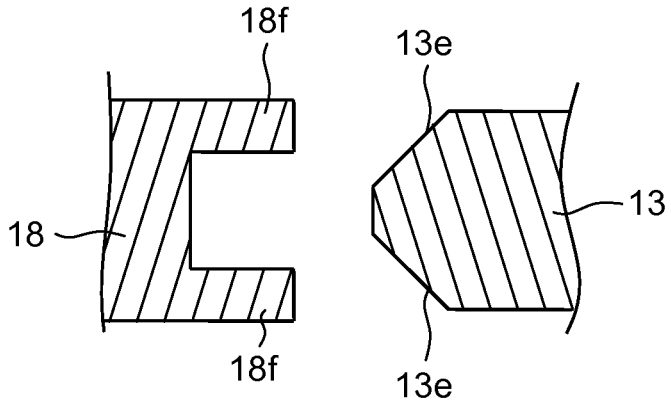
FIG. 10 is an enlarged cross-sectional view showing the structure of an operation member and a pressing-down member in a third variation of the present disclosure.

The above embodiment and the first variation may be oppositely configured. Specifically, for example, as in a second variation of the present disclosure shown in FIG. 9, in the front end portion of the operation member 18, inclination surfaces (guide portion) 18*e* that are inclined from the outer edge portion of the end portion toward the center portion as they extend away from the pressing-down member 13 may be provided. For example, as in a third variation of the present disclosure shown in FIG. 10, in the pressing-down member 13, inclination surfaces (guide portion) 13*e* that are inclined from the outer edge portion of the end portion toward the center portion as they extend closer to the operation member 18 may be provided, and in the operation member 18, a convex portion (guide portion) 18*f* that sandwiches the inclination surfaces 13*e* of the pressing-down member 13 may be provided in the operation member 18.

Figure 11:
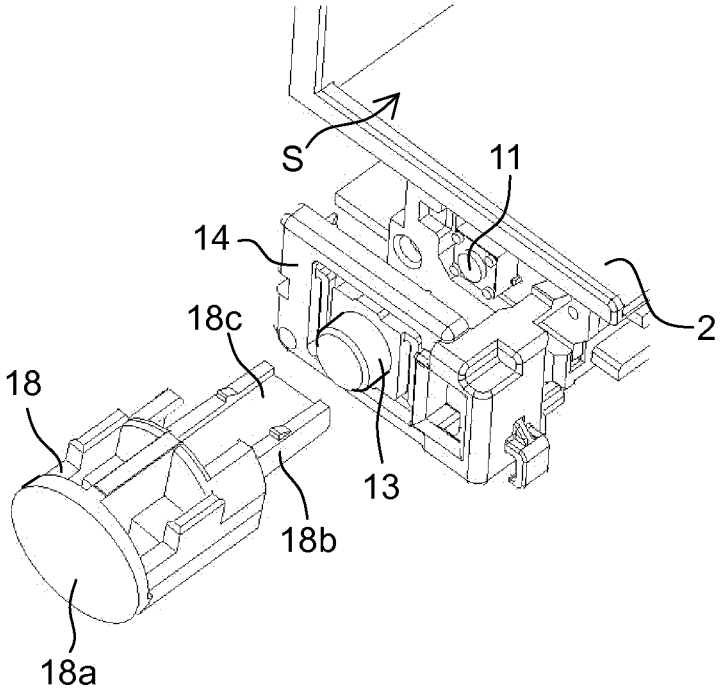
FIG. 11 is a perspective view for illustrating the structure of a pressing-down member in a fourth variation of the present disclosure.
Figure 12:
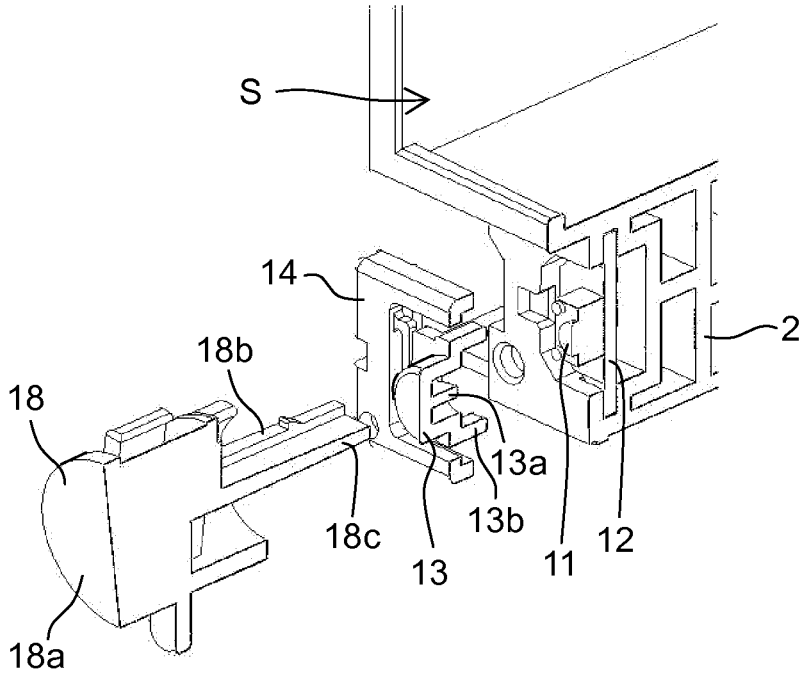
FIG. 12 is a perspective cross-sectional view for illustrating the structure of the pressing-down member in the fourth variation of the present disclosure.

Although in the above embodiment, the example where the contact portion between the pressing-down member and the operation member is formed so as to guide the center portion of the operation member to the center portion of the pressing-down member has been described, the present disclosure is not limited to this configuration. For example, as in a fourth variation of the present disclosure shown in FIGS. 11 and 12, the contact portion between the pressing-down member 13 and the operation member 18 may be formed into a flat surface without any provision of the inclination surfaces 13*c* in the pressing-down member 13.

What is claimed is:

1. A switch mechanism comprising:

a first member;

a second member that can be moved with respect to the first member;

a switch that is provided in the first member;

a pressing-down member which is provided in the first member so as to press down the switch and in which a regulation portion that restricts an amount of pressing of the switch is formed; and an operation member which is provided in the second member such that the operation member can be operated by a user and which is pressed down by the user so as to press the pressing-down member, wherein a contact portion where the pressing-down member and the operation member are brought into contact by pressing down of the operation member is formed such that a center portion of the operation member is guided to a center portion of the pressing-down member, and in the contact portion between the pressing-down member and the operation member, in any one of the pressing-down member and the operation member, a pair of inclination surfaces that sandwich a plate-shaped portion provided at an end portion of the other of the pressing-down member and the operation member in a direction of a thickness of the plate-shaped portion and a flat portion that is arranged between the pair of inclination surfaces are formed.

2. The switch mechanism according to claim 1, wherein the first member forms a part of an apparatus main body or is fixed to the apparatus main body, and the second member can be moved with respect to the apparatus main body.

3. The switch mechanism according to claim 2, wherein the second member is an opening and closing cover which is attached such that the opening and closing cover can be opened and closed with respect to the apparatus main body with one end used as a rotation pivot.

4. The switch mechanism according to claim 1, wherein the switch is a tactile switch.

5. An electronic device comprising the switch mechanism according to claim 1.

6. The electronic device according to claim 5, further comprising:

an opening and closing detection mechanism that detects an opened or closed state of the second member and that is arranged in the first member.

7. The electronic device according to claim 6, further comprising:

a notification mechanism that provides a notification that the second member is in the opened state when the opened state of the second member is detected by the opening and closing detection mechanism.

8. An image forming apparatus comprising the switch mechanism according to claim 1.

9. The image forming apparatus according to claim 8, further comprising:

an opening and closing detection mechanism that detects an opened or closed state of the second member and that is arranged in the first member.

10. The image forming apparatus according to claim 9, further comprising:

a notification mechanism that provides a notification that the second member is in the opened state when the opened state of the second member is detected by the opening and closing detection mechanism.

11. The image forming apparatus according to claim 8, further comprising:

a waste toner container that is held in a space enclosed by the second member.

12. A switch mechanism comprising:

a first member;

a second member that can be moved with respect to the first member; a switch that is provided in the first member;

a pressing-down member which is provided in the first member so as to press down the switch and in which a regulation portion that restricts an amount of pressing of the switch is formed; and an operation member which is provided in the second member such that the operation member can be operated by a user and which is pressed down by the user so as to press the pressing-down member, wherein a contact portion where the pressing-down member and the operation member are brought into contact by pressing down of the operation member is formed such that a center portion of the operation member is guided to a center portion of the pressing-down member, and in the contact portion between the pressing-down member and the operation member, at an end portion of any one of the pressing-down member and the operation member, a bar-shaped portion is formed, and in the other of the pressing-down member and the operation member, a mortar-shaped inclination surface and a flat portion arranged at a front end portion of the mortar-shaped inclination surface are formed.

* * * * *